US006951122B1

(12) United States Patent
Jheng

(10) Patent No.: US 6,951,122 B1
(45) Date of Patent: Oct. 4, 2005

(54) KEY WITH ORNAMENTAL BOW DEVICE

(76) Inventor: Shih-Siang Jheng, No. 15, Lane 20, Bei-Cheng Road, Tainan City (TW)

( * ) Notice: Subject to any disclaimer, the term of this patent is extended or adjusted under 35 U.S.C. 154(b) by 0 days.

(21) Appl. No.: 10/811,819

(22) Filed: Mar. 30, 2004

(51) Int. Cl.[7] ..... E05B 19/04; E05B 19/24

(52) U.S. Cl. ..... 70/395; 70/408; 70/456 R; 70/460; 40/330

(58) Field of Search ..... 70/408, 460, 395, 70/456 R, 457, 458; 40/330, 634; 24/3.6

(56) References Cited

U.S. PATENT DOCUMENTS

| | | | | | |
|---|---|---|---|---|---|
| 1,219,706 | A * | 3/1917 | Dahne | 40/330 |
| 2,932,107 | A * | 4/1960 | Manzardo | 40/330 |
| 4,188,741 | A * | 2/1980 | Levy | 40/330 |
| 4,349,975 | A * | 9/1982 | Chubb | 40/330 |
| 4,472,954 | A * | 9/1984 | Kichise | 70/408 |
| 5,083,662 | A * | 1/1992 | Bishop et al. | 206/37.1 |
| 5,181,927 | A * | 1/1993 | Song | 362/116 |
| 5,501,089 | A * | 3/1996 | Song | 70/456 R |
| 5,832,761 | A * | 11/1998 | Chen | 70/395 |
| 6,089,060 | A * | 7/2000 | Steeley | 70/456 R |
| 6,308,542 | B1 * | 10/2001 | Bolton | 70/408 |
| 6,604,308 | B1 * | 8/2003 | Robles | 40/330 |
| 2003/0159481 | A1 * | 8/2003 | McGuire et al. | 70/408 |

FOREIGN PATENT DOCUMENTS

| | | | |
|---|---|---|---|
| BE | 563178 | * 12/1957 | 70/459 |

* cited by examiner

*Primary Examiner*—Lloyd A. Gall
(74) *Attorney, Agent, or Firm*—Rosenberg, Klein & Lee

(57) ABSTRACT

A key includes a blade, a bow formed on an end of the blade, and an ornamental member mounted in a hole of the bow. A transparent casing accommodates the bow and thus retain the ornamental member in the hole of the bow. In another embodiment, the hole is delimited by a bottom wall, and a transparent lid is force-fitted in the hole that receives the ornamental member and thus retains the ornamental member in the hole. The key may be used as an ornament in addition to its original utility. The ornamental member can be replaced by the user with a desired one at any time when desired.

1 Claim, 7 Drawing Sheets

KEY WITH ORNAMENTAL BOW DEVICE

BACKGROUND OF THE INVENTION

1. Field of the Invention

The present invention relates to a key with an ornamental bow device.

2. Description of the Related Art

A wide variety of locks have heretofore been provided for protecting property, privacy, etc. Except for number locks, a lock is used with a key. Thus, keys become a daily necessity. A typical key includes a bow and a blade, wherein the blade is processed to have a particular shape for locking/unlocking purposes. A plastic protective layer may be coated on the bow to provide a place for a trade name or advertisements without providing any ornamental effect. The present invention is intended to provide a key with an ornamental bow device.

SUMMARY OF THE INVENTION

In accordance with an aspect of the present invention, a key includes a blade, a bow formed on an end of the blade, an ornamental member mounted in a hole of the bow, and means for retaining the ornamental member in the hole of the bow.

In an embodiment of the invention, the hole is delimited by a transparent or non-transparent bottom wall, and said means for retaining the ornamental member includes a transparent lid force-fitted in the hole that receives the ornamental member. The ornamental member can be removed from the hole of the bow.

In another embodiment, said means for retaining the ornamental member includes a transparent casing that accommodates the bow. The transparent casing may be formed on and covers the bow by means of injection molding.

In a further embodiment, the hole extends along a periphery of the bow.

The key may be used as an ornament in addition to its original utility. A user can replace the ornamental member with a desired one at any time.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
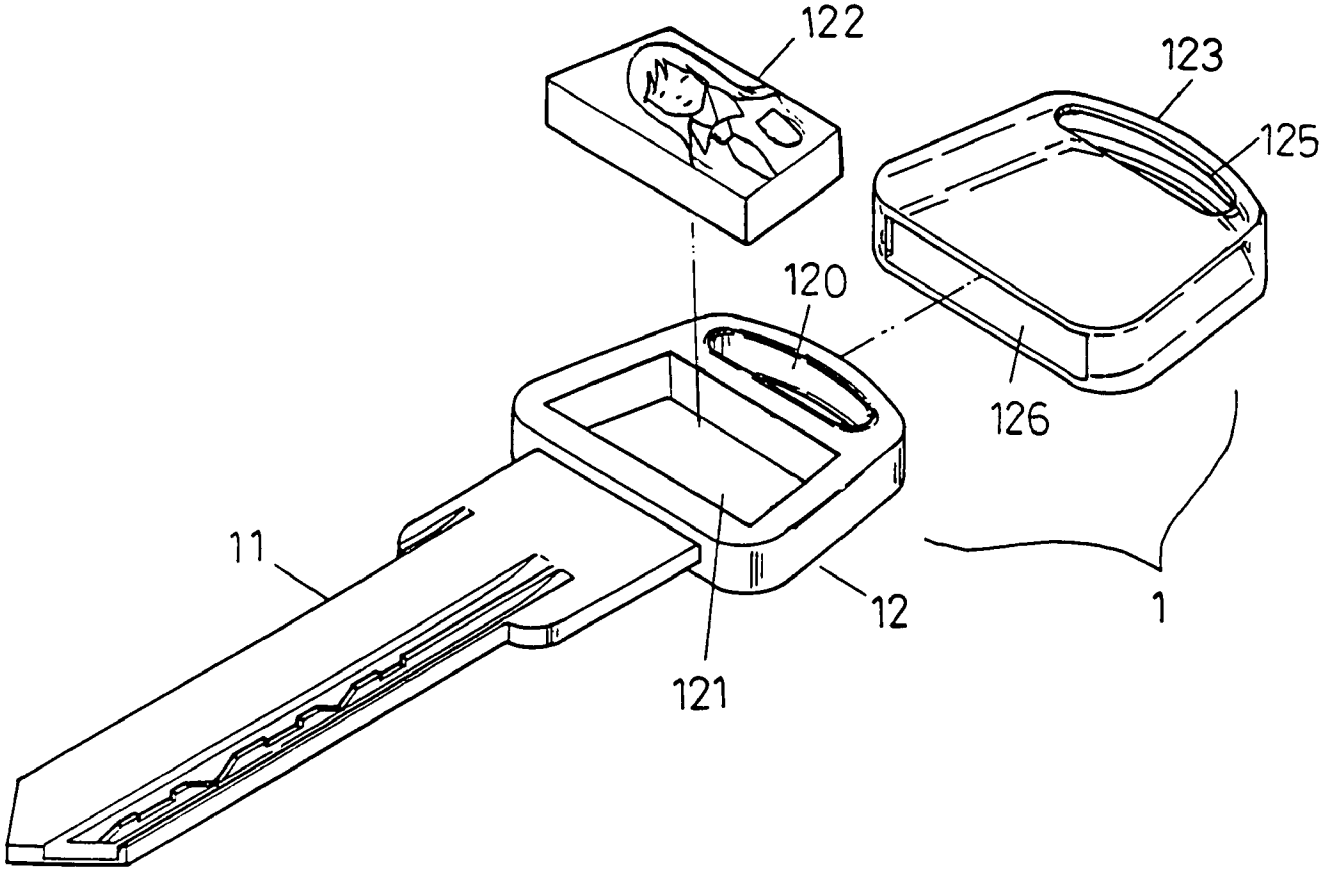
FIG. 1 is an exploded perspective view of a key in accordance with the present invention.
Figure 2:
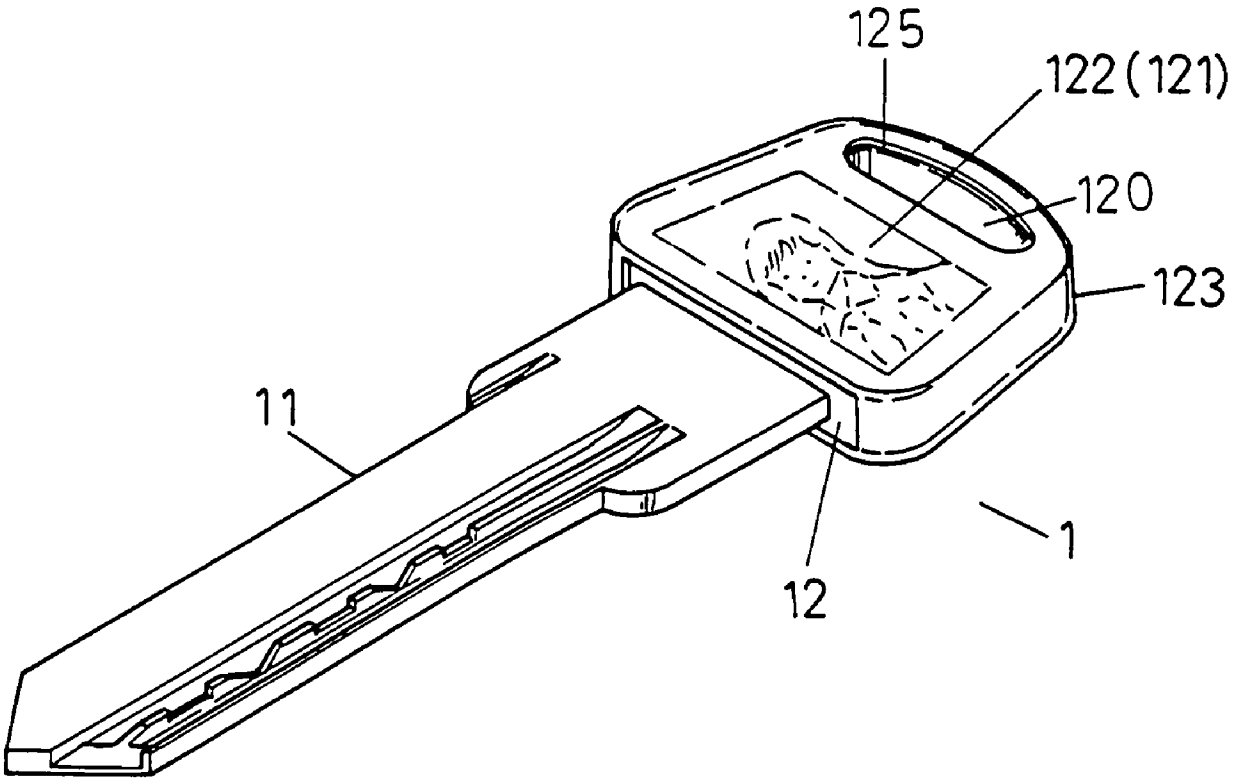
FIG. 2 is a perspective view of the key in accordance with the present invention.
Figure 3:
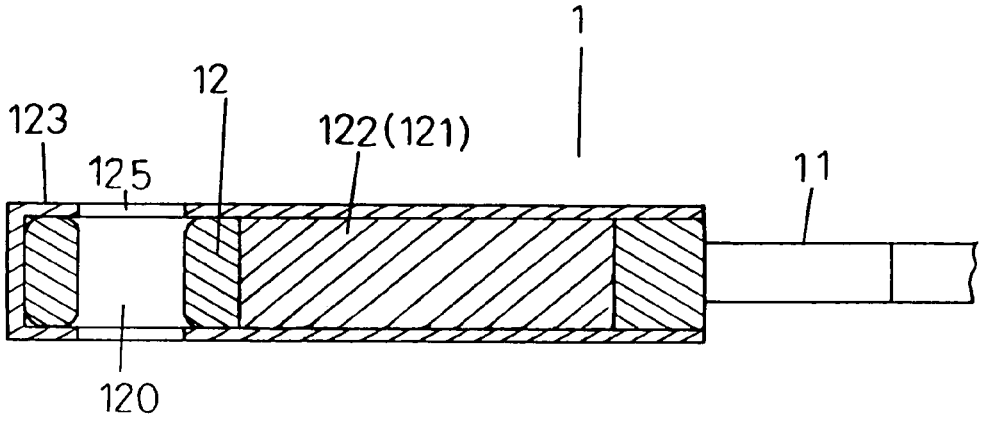
FIG. 3 is a sectional view of a portion of the key in accordance with the present invention.

Referring to FIGS. 1 through 3, a key in accordance with the present invention is designated by "1" and includes a blade 11 and a bow 12 formed on an end of the blade 11. The bow 12 includes a hole 121 for receiving an ornamental member 122 with a picture, photograph, letters, patterns, etc formed thereon. After the ornamental member 122 is placed in the hole 121 of the bow 12, a transparent casing 123 is mounted to the bow 12 and to fix the ornamental member 122 in the hole 121 of the bow 12. The casing includes front and back walls joined by an end wall, and a first opening receives the blade 11. Namely, the bow 12 is accommodated in a compartment 126 of the transparent casing 123. The bow 12, the ornamental member 122, and the transparent casing 123 constitute an ornamental device of the key in accordance with the present invention. Alternatively, the transparent casing 123 may be formed on and covers the bow 12 by means of injection molding.

Figure 7:
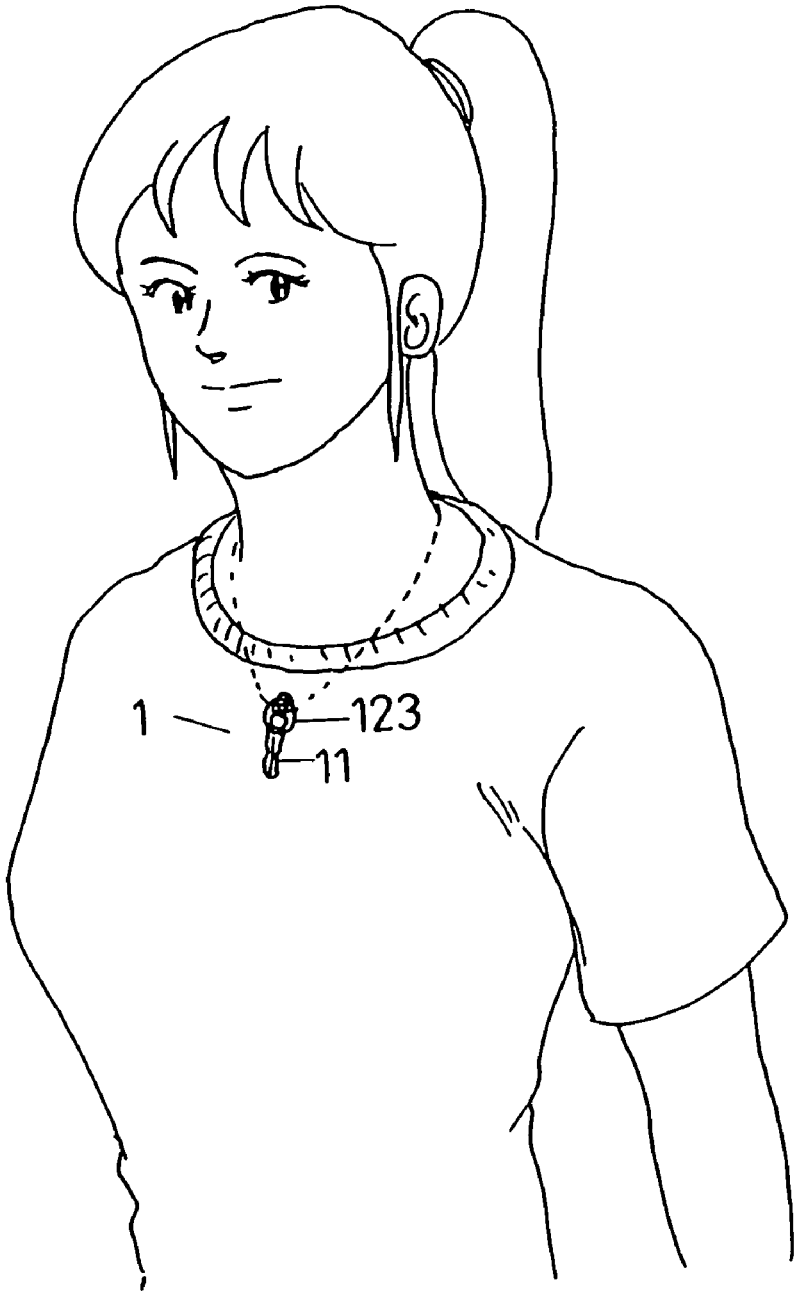
FIG. 7 is a perspective view illustrating an ornamental use of the key in accordance with the present invention.

The hole 121 of the bow 12 may be a hole through opposing faces. The bow 12 further includes a hole 120, and the transparent casing 123 includes a hole 125 that is at least partially aligned with the hole 120 of the bow 12. Referring to FIG. 7, a string or the like (not labeled) may be extended through the openings 125 of the transparent casing 123 and the hole 120 of the bow 12. The user may put the string around his or her neck, providing an ornamental effect. Thus, the key may be used as an ornament in addition to its original utility. The ornamental member 122 can be replaced by the user with a desired one at any time when desired.

Figure 4:
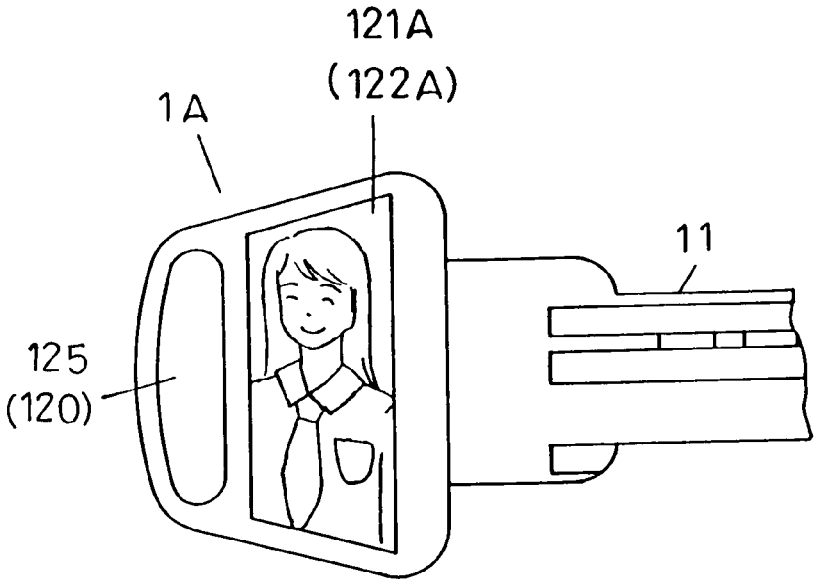
FIG. 4 is a top view of a portion of a modified embodiment of the key in accordance with the present invention.
Figure 5:
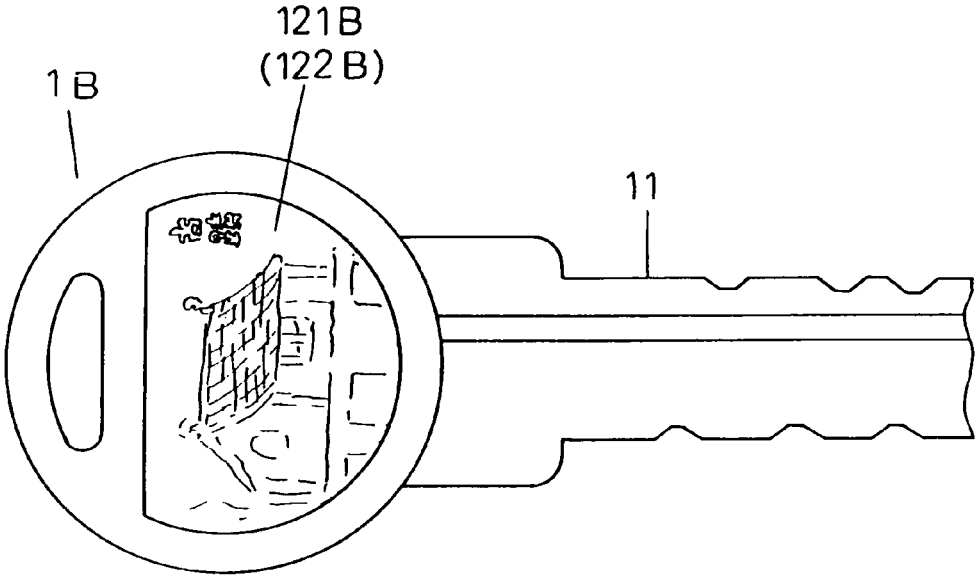
FIG. 5 is a top view of a portion of another modified embodiment of the key in accordance with the present invention.
Figure 6:
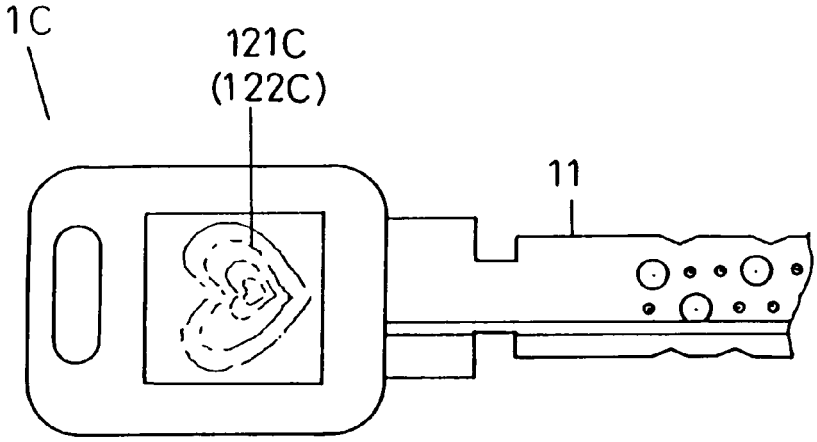
FIG. 6 is a top view of a portion of a further modified embodiment of the key in accordance with the present invention.

FIGS. 4 through 6 show modified embodiments of the key, wherein the bow 12 of the key 1A, 1B, 1C has a different shape, and the hole 121A, 121B, 121C of the bow 12 of the key 1A, 1B, 1C has a different shape corresponding to the shape of the bow 12. It is noted that the hole 121A, 121B, 121C extends along a periphery of the bow 12 of the key 1A, 1B, 1C. Further, the ornamental member 122A, 122B, 122C has a different picture (or pattern, letters, etc). Thus, various ornamental effects can be provided and optionally selected.

Figure 8:
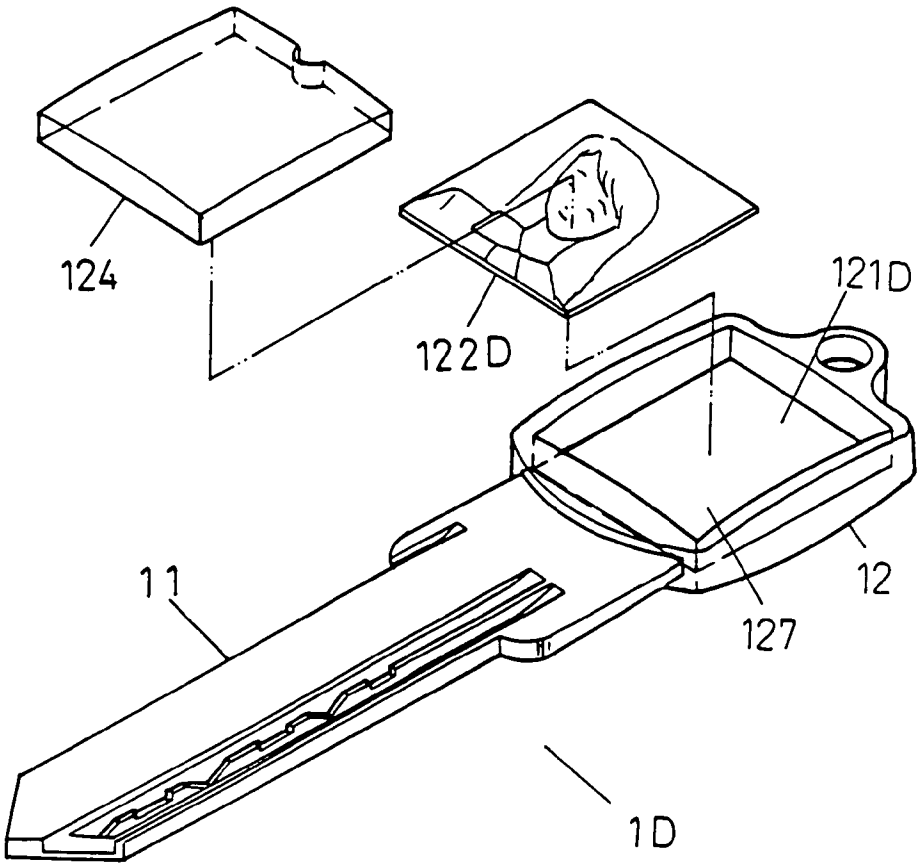
FIG. 8 is an exploded perspective view of still another modified embodiment of the key in accordance with the present invention.
Figure 9:
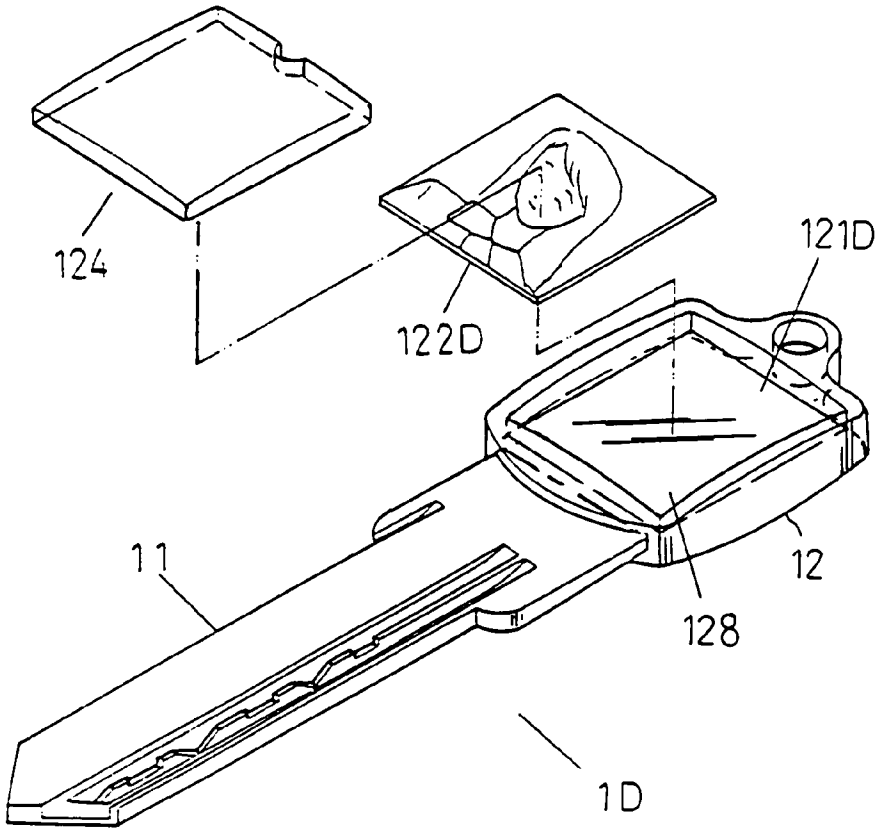
FIG. 9 an exploded perspective view of an embodiment modified from the embodiment of FIG. 8

FIG. 8 illustrates another modified embodiment of the key. In this embodiment, the key ID includes a blade 11 and a bow 12 formed on an end of the blade 11. The bow 12 defines a hole 121D delimited by a non-transparent bottom wall 127. An ornamental member 122D is received in the hole 121D, and a transparent lid 124 is then force-fitted in the hole 121D of the bow 12 and thus retain the ornamental member 122D in the hole 121D. Thus, the key may be used as an ornament in addition to its original utility. Further, a user can replace the ornamental member with a desired one at any time. FIG. 9 illustrates an embodiment modified from the embodiment of FIG. 8, wherein the bottom wall (now designated by 128) is transparent to provide a different aesthetically pleasing effect.

Although the invention has been explained in relation to its preferred embodiment, it is to be understood that many other possible modifications and variations can be made without departing from the scope of the invention as hereinafter claimed.

What is claimed is:

1. A key comprising:

a blade;

a bow formed on an end of the blade, the bow having a pair of opposing faces, a first hole formed through the opposing faces and a second hole formed through the opposing faces adjacent an outer end thereof;

an ornamental member mounted in the first hole of the bow; and a transparent casing having opposing front and back walls spaced from each other and joined by an end wall extending along a perimeter of the front and back walls to define a compartment therebetween, the casing having a first opening in a distal end thereof in open communication with the compartment, the bow being disposed in the compartment to thereby retain the ornamental member in the hole of the bow, the blade extending through the first opening of the casing and the casing having a pair of second openings respectively formed in aligned relationship through the front and back walls, the pair of second openings being disposed in at least partially aligned relationship with the second hole of the bow.

* * * * *